US005479957A

United States Patent [19]

Crow et al.

[11] Patent Number: 5,479,957

[45] Date of Patent: Jan. 2, 1996

[54] SLUDGE PIPELINE LUBRICATION SYSTEM

[75] Inventors: Harry Crow, Richfield, Conn.; Thomas M. Anderson, Hugo, Minn.; Scott Kelly, Pleasanton, Calif.; Terry Atherton, Excelsior; Larry Schmidt, Lino Lakes, both of Minn.

[73] Assignee: Schwing America, Inc., White Bear, Minn.

[21] Appl. No.: 273,191

[22] Filed: Jul. 11, 1994

Related U.S. Application Data

[63] Continuation of Ser. No. 70,516, Jun. 1, 1993, Pat. No. 5,361,797.

[51] Int. Cl.[6] ..... F17D 1/16

[52] U.S. Cl. ..... 137/101.19; 137/896

[58] Field of Search ..... 137/13, 101.19, 137/515.7, 896–898; 417/197

[56] References Cited

U.S. PATENT DOCUMENTS

| | | | |
|---|---|---|---|
| 628,187 | 7/1899 | Sibley | 417/197 |
| 2,821,205 | 1/1958 | Chilton et al. | 137/13 |
| 2,930,400 | 3/1960 | Wheatley | 137/527.8 |
| 3,175,571 | 3/1965 | Bankert | 137/13 X |
| 3,414,004 | 12/1968 | Bankston | 137/237 |
| 3,502,103 | 3/1970 | Verschuur | 137/567 |
| 3,601,079 | 8/1971 | Giles et al. | 114/67 |
| 3,608,975 | 9/1971 | Sawyer et al. | 302/14 |
| 3,655,298 | 4/1972 | Baker | 417/197 X |
| 3,817,277 | 6/1974 | Wheatley | 137/515.7 |
| 3,826,279 | 7/1974 | Verschuur | 137/604 |
| 3,886,972 | 6/1975 | Scott et al. | 137/602 |
| 3,993,097 | 11/1976 | Verschuur | 137/604 |
| 4,510,958 | 4/1985 | Coursen | 137/13 |

FOREIGN PATENT DOCUMENTS 1105100 4/1989 Japan .

*Primary Examiner*—Robert G. Nilson
*Attorney, Agent, or Firm*—Kinney & Lange

[57] ABSTRACT

A system for lubricating a plug flow of high viscosity material in a pipeline is disclosed. The system includes first and second pipes through which the plug flow of high viscosity material is pumped. The first pipe has a flange which is positioned adjacent a flange of the second pipe. A plurality of bolts, attached to the flange of the first pipe and to the flange of the second pipe, connect the first pipe to the second pipe. A lubrication spool is positionable in a first location between the flange of the first pipe and the flange of the second pipe for lubricating the plug flow of high viscosity material. The lubrication spool is removable from the first position without completely disconnecting the first and second pipes. The lubrication spool includes a first spool section which is located immediately adjacent the flange of the first pipe while in the first position and a second spool section immediately adjacent the first spool section. The second spool section is also located immediately adjacent the flange of the second pipe while in the first position. An aperture in the first and second spool sections provides a passage for the plug flow of high viscosity material being pumped between the first and second pipes. An annular reservoir, formed between the first and second spool sections, distributes lubricant. An inlet supplies lubricant to the reservoir. A circumferential lubrication passage, formed between the first and second spool sections, applies a uniform ring of the lubricant to the plug flow of high viscosity material being pumped through the lubrication spool aperture. The circumferential lubrication passage provides a fluid path between the annular reservoir and the aperture.

19 Claims, 3 Drawing Sheets

42
44
10
40
22
12
32
24
20
16
26
34
30
29
28
PIPELINE FLOW
DIRECTION
15
34
17
27
31
36
14
18
36
38
22

SLUDGE PIPELINE LUBRICATION SYSTEM

This is a continuation of application Ser. No. 08/070,516, filed Jun. 1, 1993. Priority of the prior application is claimed pursuant to 35 USC § 120, now U.S. Pat. No. 5,361,797.

BACKGROUND OF THE INVENTION

The present invention relates to systems for lubricating high viscosity material in a pipeline. In particular the present invention relates to a pipeline lubrication system with a lubrication spool which can be positioned between flanged ends of first and second pipes to lubricate a plug flow of high viscosity material and which can be removed from the position between the first and second pipes without disturbing the integrity of the pipeline system.

Pump and pipeline systems are frequently used to convey high viscosity materials such as sludge and concrete over long distances. In these applications, sludge is generally defined as a high viscosity material which typically has no free flow characteristics. High viscosity materials are typically pumped through a pipeline in a plug flow. Pumping a plug flow of high viscosity material over a long distance through a pipeline requires a pump capable of producing high pumping pressures to overcome friction between the high viscosity material and the pipeline. The further the material has to be pumped through the pipeline, the greater the pressure that is required, and therefore the greater the horsepower requirements of the pump.

When pumped through a pipeline under pressure, a plug flow of material such as sludge releases liquids which form a film of lubricant around the flow. The lower the liquid content of the material being pumped, the less liquid available for lubrication. For this reason, dryer materials will experience more friction and will therefore require higher pumping pressures than are necessary to pump materials with higher liquid contents.

Typically, lubrication of a plug flow is necessary only when the material being pumped doesn't contain enough liquid to form a film of lubricant around the inner wall of the pipeline. Adding a layer of lubricant around a plug flow of these materials results in lower pumping pressures and increased capability of pumping the material greater distances at a given pressure.

With materials such as sludge, liquids may well have been intentionally removed prior to pumping. In these instances, it is not desirable to substantially increase the liquid content of the material being pumped in order to increase the material's pumpability. A number of pipeline lubrication systems have been developed to lubricate a flow of high viscosity material in a pipeline without substantially increasing the liquid content of the material. An example of such a pipeline lubrication system is disclosed in Coursen, U.S. Pat. No. 4,510,958. Coursen discloses an apparatus and method for injecting a lubricating liquid into a conduit around a flow of high viscosity material. The lubricant is injected through a slanted circumferential slot in the direction of the flow of the high viscosity material. Injecting the lubricant through the slanted circumferential slot in the direction of the material flow reduces resistance against the flow and also helps to prevent the high viscosity material from clogging the circumferential slot.

Although pipeline lubrication systems like the one disclosed in Coursen help increase the pumpability of high viscosity materials, they have significant disadvantages. One very important disadvantage of prior art lubrication systems is that, in order to remove the lubrication mechanism from the pipeline, the pipeline must be disassembled. Once disassembled, it is very difficult to reconnect adjacent pipe sections. Pipe sections are under extreme stress, and when disconnected, they frequently contract or otherwise shift to such an extent that they cannot be easily reconnected.

SUMMARY OF THE INVENTION

The present invention is based upon the recognition that a pipeline lubrication system having a lubrication spool which can be positioned between flanged ends of first and second pipes to lubricate a plug flow of high viscosity material and which can be removed from the position between the first and second pipes without completely disconnecting the pipes, provides an effective means of lubricating a pipeline while retaining the capability of easily removing the lubrication spool for replacement or cleaning without disturbing the integrity of the pipeline system.

The pipeline lubrication system of the present invention includes first and second pipes through which the plug flow of high viscosity material is pumped. The first pipe has a flange which is positioned adjacent a flange of the second pipe. A plurality of bolts, attached to the flange of the first pipe and to the flange of the second pipe, connect the first pipe to the second pipe. A lubrication spool is positionable in a first location between the flange of the first pipe and the flange of the second pipe for lubricating the plug flow of high viscosity material. The lubrication spool is removable from the first position without completely disconnecting the first and second pipes.

The lubrication spool includes a first spool section which is located immediately adjacent the flange of the first pipe while in the first position and includes a second spool section immediately adjacent the first spool section. The second spool section is also located immediately adjacent the flange of the second pipe while in the first position. An aperture in the first and second spool sections provides a passage for the plug flow of high viscosity material being pumped between the first and second pipes. An annular reservoir, formed between the first and second spool sections, distributes lubricant. An inlet supplies lubricant to the annular reservoir. A circumferential lubrication passage, formed between the first and second spool sections, applies a uniform ring of lubricant to the plug flow of high viscosity material being pumped through the lubrication spool aperture. The circumferential lubrication passage provides a fluid path between the annular reservoir and the aperture.

DETAILED DESCRIPTION OF THE PREFERRED EMBODIMENTS

Figure 1:
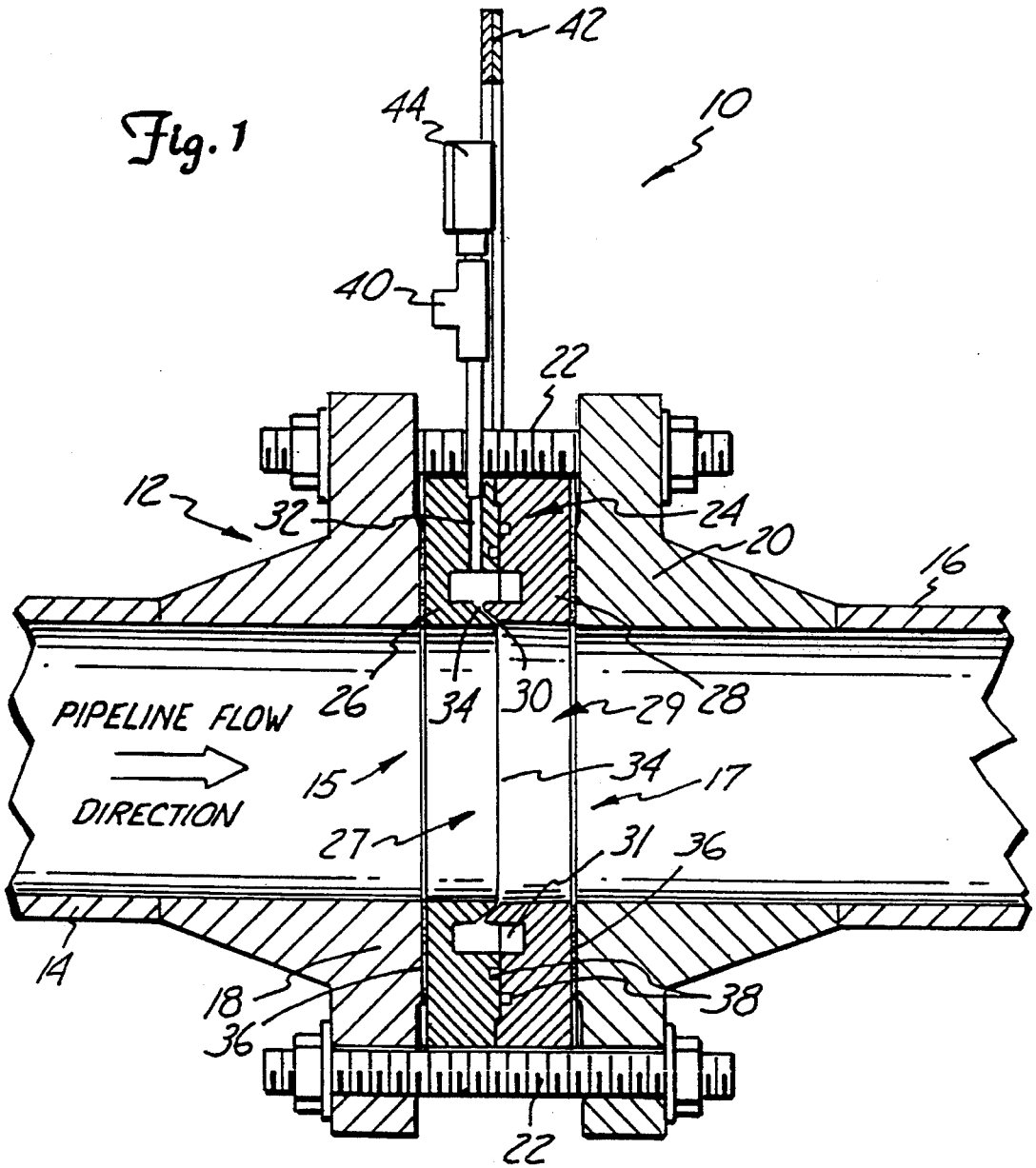
FIG. 1 is a sectional side view of the pipeline lubrication system of the present invention.

FIG. 1 shows a perspective view of pipeline lubrication system 10 of the present invention. Pipeline lubrication system 10 includes pipeline 12 which has first and second pipes 14 and 16 with first and second pipe apertures 15 and 17, respectively. Pipeline 12 also includes flanges 18 and 20 at the ends of pipes 14 and 16. A plurality of bolts 22 are connected to flanges 18 and 20 to hold pipes 14 and 16 of pipeline 12 together.

Pipeline lubrication system 10 also includes lubrication spool 24 which has first and second spool sections 26 and 28. First spool section aperture 27 extends through first spool section 26. Second spool section aperture 29 extends through first spool section 28. Apertures 27 and 29 are aligned to form an aperture or passage for high viscosity material being pumped between pipes 14 and 16. The passage formed by apertures 27 and 29 has a substantially continuous diameter approximately equal to the diameter of pipe apertures 15 and 17 of pipes 14 and 16. However, angled or beveled edge 30 of aperture 29 has a slightly varying diameter in which, at its largest point, the diameter of aperture 29 is slightly larger than the rest of apertures 15, 17 and 27. In preferred embodiments, at a point closest to first spool section 26, beveled edge 30 gives aperture 29 a diameter which is approximately one millimeter larger than the diameter of spool sections 15, 17 and 27. At a point closest to second pipe 16, the diameter of aperture 29 is preferably the same as the diameters of apertures 15, 17 and 27. Because of its configuration, beveled edge 30 makes it possible to inject lubricant around, instead of into, a plug flow of material being pumped between pipes 14 and 16.

Annular reservoir or pocket 31 is formed between spools sections 26 and 28. Also formed between spool sections 26 and 28 is circumferential lubrication passage 34. Entry port 32 can be formed in either of spool sections 26 and 28, or in the alternative, can also be formed between spool sections 26 and 28.

Pipeline lubrication system 10 also includes high pressure gaskets 36 which are located between lubrication spool 24 and the faces of flanges 18 and 20, respectively, to provide a fluid tight seal between flanges 18 and 20 and lubrication spool 24. Likewise, O-rings 38 are located between spool sections 26 and 28 to provide a fluid tight seal between the two sections. Inlet 40 is connected to reservoir 31 through entry port 32. By connecting inlet 40 to a source of lubricant, lubrication fluid can be supplied to reservoir 31.

Although in one preferred embodiment there exists only one entry port 32 connecting a single inlet 40 to reservoir 31, in other preferred embodiments, a plurality of entry ports 32 connect a plurality of inlets to reservoir 31. A throttle valve could be used at each entry port to insure equal injection pressure around the entire circumference of annular reservoir 31. In these other embodiments, lubricant supplied to lubrication spool 24 can be distributed more evenly throughout reservoir 31. In yet other preferred embodiments, a check valve could be employed at each entry port 32 to prevent backfeed of the high viscosity material from passing through each entry port 32 in the opposite direction.

Handle 42 is coupled to lubrication spool 24 to aid in the removal of lubrication spool 24 from its position between flanges 18 and 20 of pipes 14 and 16. Pressure gauge 44 is coupled to inlet 40 and/or entry port 32. Pressure gauge 44 senses pressure of the lubricant.

In preferred embodiments, bolts 22 act both to connect pipe 14 to pipe 16, and to hold lubrication spool 24 in position between flanges 18 and 20 of pipes 14 and 16. However, in other embodiments, bolts 22 could function only to connect pipe 14 to pipe 16, while other means of holding lubrication spool 24 in position between flanges 18 and 20 are used. Also, it should be noted that bolts 22 are only one means of connecting pipes 14 and 16, and could be replaced with other types of fasteners.

In operation, a plug flow of sludge or other high viscosity material is pumped through pipeline 12 in a downstream direction, from pipe 14, through apertures 27 and 29 of lubrication spool 24, to pipe 16. As the plug flow of high viscosity material is pumped through pipeline 12, friction between the material and the inner walls of pipes 14 and 16 causes back pressure which resists the flow of high viscosity material. Lubrication fluid from a source of lubricant is supplied to inlet 40 of lubrication spool 24 and flows through entry port 32 into annular reservoir 31. The lubrication fluid can be water, oil, a polymer solution or any other liquid lubricant. Under pressure from the source of lubricant, lubrication fluid disperses around annular reservoir 31. Lubrication fluid next flows from annular reservoir 31 through circumferential lubrication passage 34. Because of the circumferential design of lubrication passage 34, lubrication fluid is injected into beveled edge 30 and forms a uniform ring around the outer wall of aperture 29 of spool section 28.

The angle of lubrication passage 34 formed between spools sections 26 and 28 causes lubricant to be injected with a component in the same direction as the pipeline flow. This provides several advantages. First, forming lubrication passage 34 at an angle in the direction of pipeline flow limits penetration of lubricant into the plug flow of high viscosity material. This is important because in many applications, such as in the pumping of sludge to an incinerator, it is not desirable to substantially increase the liquid content of the high viscosity material. It is also important because the lubricant is less efficient, and practically useless, if it penetrates the high viscosity material. To provide lubrication, it must remain on the outside of the plug flow. A second advantage of forming lubrication passage 34 at an angle in the direction of pipeline flow is to avoid back pressure against the plug flow of high viscosity material caused by the injected lubricant. Finally, forming lubrication passage 34 at such an angle avoids clogging of circumferential lubrication passage 34 with high viscosity material.

As lubricant is injected into aperture 29 of lubrication spool 24, friction between the plug flow of high viscosity material and the inner walls of pipe 16 decreases, thus increasing the pumpability of the high viscosity material. Therefore, high viscosity materials may be pumped further through pipeline 12 or, in the alternative, can be pumped at lower pumping pressures and with lower horsepower requirements for the pump without dramatically changing the liquid content of the high viscosity material.

In applications where pipeline 12 is of considerable length, a number of lubrication spools 24 could be spaced along the pipeline at predetermined intervals to lubricate the plug flow. If at some point a wetter material was pumped through the pipeline, unneeded lubrication spools could be removed and replaced with blanks or spools having apertures of the same diameter as pipes 14 and 16, but which do not supply lubricant.

Figure 2:
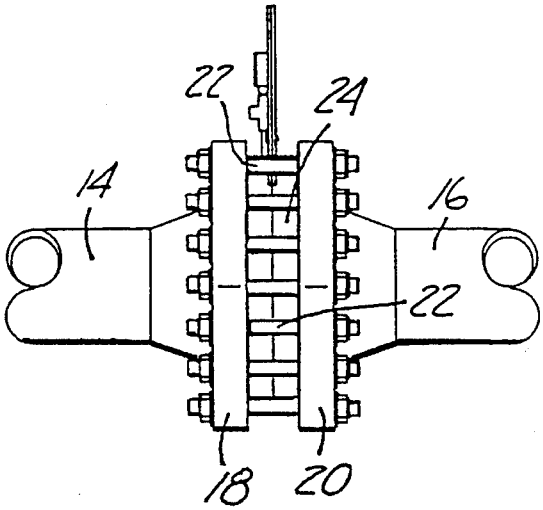
FIG. 2 is a side view of the pipeline lubrication system shown in FIG. 1.

FIGS. 2–7 are side views illustrating an important aspect of the present invention, the removability of lubrication spool 24 from between pipes 14 and 16 without completely disconnecting the pipes. In FIG. 2, pipe 14 is shown connected to pipe 16 by bolts 22 attached to flanges 18 and 20. Lubrication spool 24 is positioned between flanges 18 and 20 for lubricating a plug flow of high viscosity material being pumped between pipes 14 and 16. Bolts 22 act both to hold pipes 14 and 16 together and also to keep lubrication spool 24 in position between flanges 18 and 20.

Figure 3:
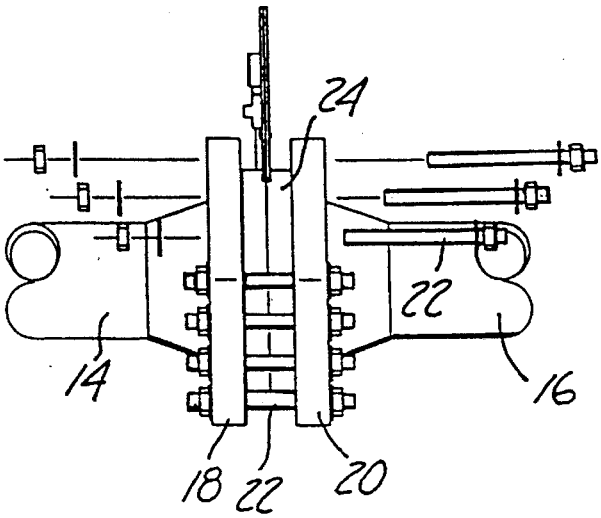
FIG. 3 is a side view of a partially disassembled pipeline lubrication system in accordance with the present invention.

As shown in FIG. 3, some of bolts 22 may be disengaged to allow lubrication spool 24 to be removed from its position between flanges 18 and 20, while other of bolts 22 are left in place to keep pipe 14 connected to pipe 16.

Figure 4:
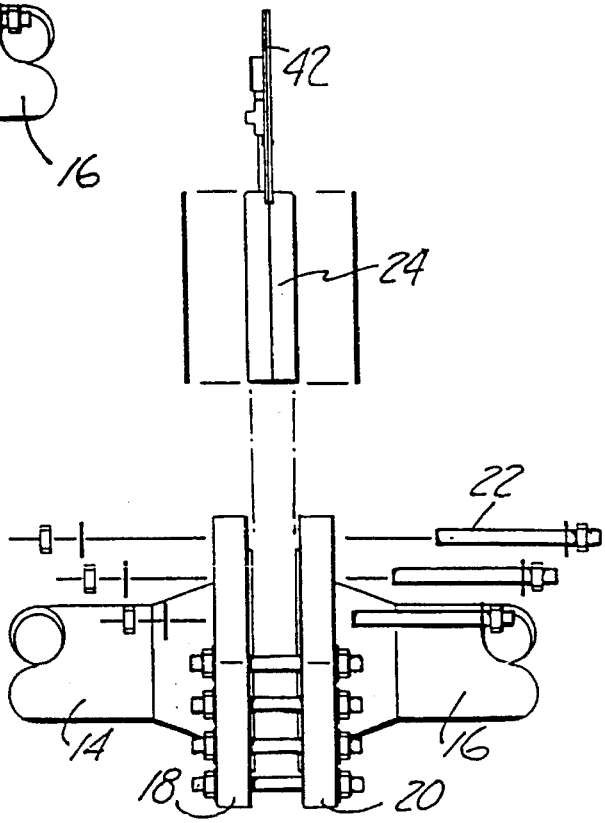
FIG. 4 is a side view of the partially disassembled pipeline lubrication system shown in FIG. 3, with the lubrication spool removed.

In FIG. 4, lubrication spool 24 is shown removed from its position between flanges 18 and 20. Removal of lubrication spool 24 is facilitated with handle 42 which is connected to lubrication spool 24. While removed, lubrication spool 24 may be cleaned, repaired or replaced. During this time, some of bolts 22 remain attached to flanges 18 and 20, thus keeping pipes 14 and 16 connected. It is necessary to keep pipes 14 and 16 connected since, if completely disconnected, the integrity of pipeline 12 may be disturbed because pipes 14 and 16 frequently contract or otherwise shift to such an extent that they cannot be easily reconnected.

Figure 5:
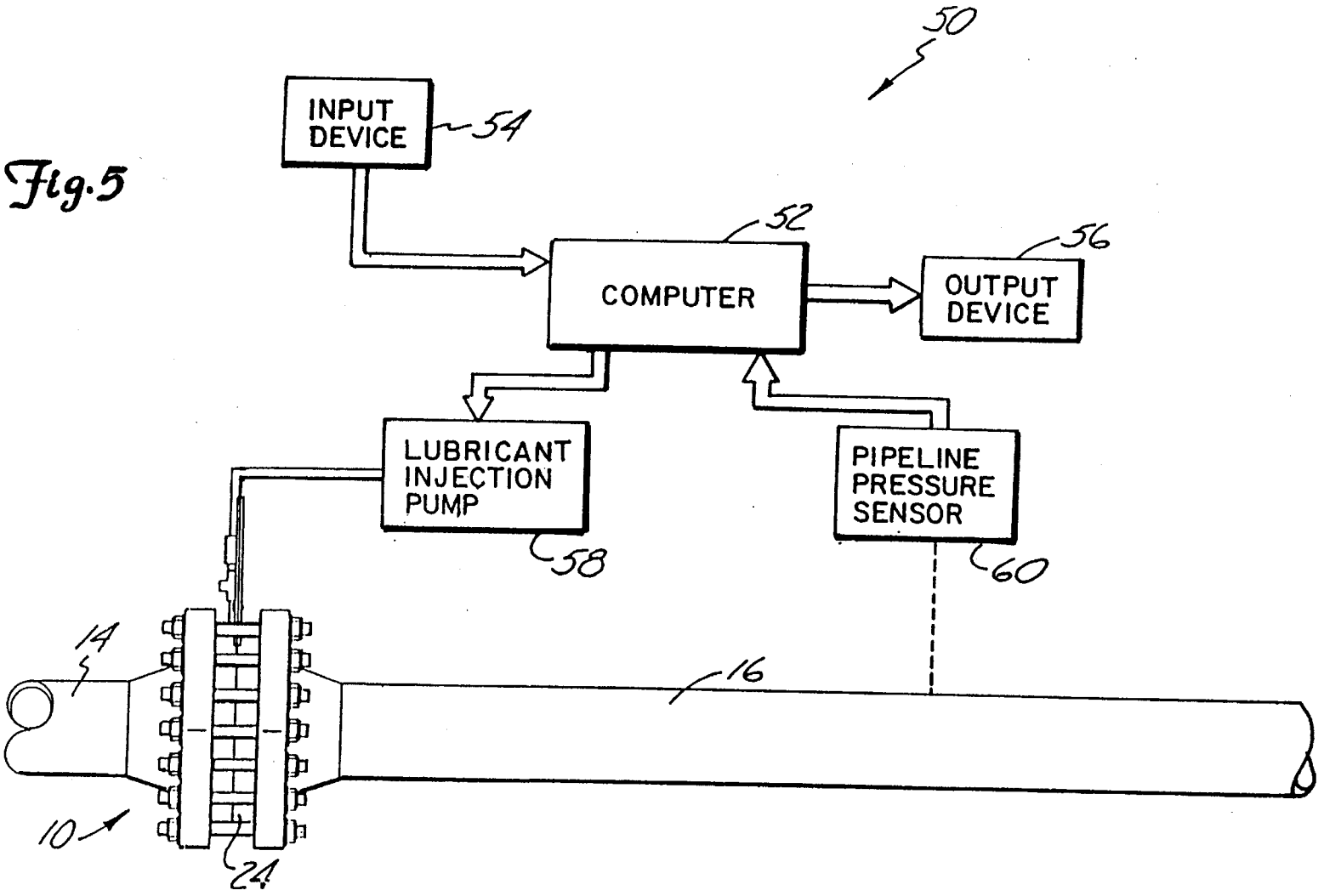
FIG. 5 is a block diagram of a pipeline lubrication monitoring system in accordance with the present invention.

FIG. 5 shows a preferred embodiment of the present invention in which operation of pipeline lubrication system 10 is monitored by system 50. Monitor system 50 includes computer 52, which in a preferred embodiment is a microprocessor-based computer including associated memory and associated input/output circuitry. In other embodiments of the present invention, monitor system 50 includes a programmable logic controller instead of computer 52. Monitor system 50 also includes input device 54, output device 56, lubricant injection pump 58, and pipeline pressure sensor 60.

Input device 54 is preferably any of a number of devices. In one preferred embodiment, input device 54 is a keypad entry device. Input device 54 can also be a keyboard, a remote program device or any other suitable mechanism for providing information to computer 52. For example, device 54 can be used to provide computer 52 with operational information related to the characteristics of a material pump located upstream of system 10.

Output device 56 can also take a variety of forms. For example, output device 56 can include a display output such as a cathode ray tube or liquid crystal display. Output device 56 can also be a printer, or a communication device such as a cellular phone which transmits the output of computer 52 to another computer-based system (which may monitor the overall operation in which pipeline lubrication system 10 is being used). Output device 56 could be used to inform an operator of information such as the quantity of lubricant added to the high viscosity material, of the percentage increase in liquid content of the high viscosity material as a result of adding lubricant, or of diagnostic information concerning pipeline lubrication system 10 or monitor system 50.

Lubricant injection pump 58 supplies lubrication fluid to lubrication spool 24. Pump 58 is, in preferred embodiments, a variable speed pump which is capable of supplying lubricant to spool 24 over a range of flow rates. Pump 58 must be capable of pumping lubricant at pressures which exceed the anticipated pressure of the high viscosity material in pipeline 12. Otherwise, pump 58 will not be able to overcome the pipeline pressures and inject lubricant around the plug flow.

Pipeline pressure sensor 60 is preferably an analog pressure sensor or a digital pressure sensor located downstream of lubrication spool 24 in pipe 16. Sensor 60 provides computer 52 with information on material pressure in pipe 16. In other preferred embodiments, sensor 60 could be located further downstream in pipeline 12. Additionally, system 50 could include any number of pressure sensors spaced apart along downstream sections of pipeline 12.

In a preferred embodiment, a user of monitor system 50 inputs a predetermined threshold pressure value through input device 54. As pumping of high viscosity material begins, computer 52 monitors signals from one or more pipeline pressure sensors 60. When the downstream pressure in pipeline 12 increases to the point that it exceeds the predetermined threshold pressure value, computer 52 generates a control signal that causes pump 58 to begin supplying lubricant to lubrication spool 24. If the downstream pressure sensed by sensors 60 continues to increase, computer 52 generates signals which cause pump 58 to increase the supply of lubricant to lubrication spool 24.

Similarly, as the downstream pressure sensed by sensors 60 decreases, computer 52 causes pump 58 to decrease the supply of lubricant to lubrication spool 24. If the sensed pressure falls below the predetermined threshold value, computer 52 causes pump 58 to stop supplying lubricant to lubrication spool 24.

In this way, lubrication spool 24 and pump 58 do not have to operate constantly. Together with the rest of monitoring system 50, lubrication spool 24 can be used as a control system which provides only that lubrication which is necessary in order to move the plug flow of high viscosity material the desired distance at the desired pumping pressures.

In other embodiments, a number of lubrication spools 24, pressure sensors 60 and pumps 58 are spaced along the length of pipeline 12. Computer 52 monitors the pressures sensed by sensors 60 and controls each pump 58 separately. In this way, some of pumps 58 could be shut down while others continued to supply lubricant as pumping pressures drop.

Although the present invention has been described with reference to preferred embodiments, workers skilled in the art will recognize that changes may be made in form and detail without departing from the spirit and scope of the invention. For example, in other preferred embodiments, a lubricant injection pump 58 could receive control signals directly from one or more pipeline pressure sensors 60 instead of from computer 52.

What is claimed is:

1. In a pipeline for conveying high viscosity material, a system for lubricating a plug flow of high viscosity material in the pipeline, the system comprising:

a first pipe section through which the plug flow of high viscosity material is pumped:

a second pipe section through which the plug flow of high viscosity material is pumped, the second pipe section being located downstream from the first pipe section:

a coupling for connecting the first pipe section to the second pipe section; and a lubrication spool for lubricating the plug flow of high viscosity material, the lubrication spool being positionable in a first position between the first and second pipe sections for lubricating the plug flow of high viscosity material and being removable from the first position without completely disconnecting the first and second pipe sections, the lubrication spool having a thickness measured between the first pipe section and the second pipe section when the lubrication spool is in the first position and a diameter, perpendicular to the thickness, measured between the edges of the lubrication spool and passing through the center of the lubrication spool, the thickness smaller than the diameter, the lubrication spool comprising:

an aperture extending through the lubrication spool, the aperture being aligned between the first and second pipe sections such that it provides a passage for the plug flow of high viscosity material being pumped between the first and second pipe sections when the lubrication spool is in the first position; and at least one lubrication passage for applying lubricant to the plug flow of high viscosity material, each lubrication passage providing a fluid path from a lubrication source to the aperture.

2. The system of claim 1 wherein the coupling for connecting the first pipe section to the second pipe section is a plurality of bolts.

3. The system of claim 2 wherein the lubrication spool is removable from the first position by removing at least one but not all of the plurality of bolts.

4. The system of claim 1 wherein each lubrication passage is formed at an angle relative to the aperture such that lubricant is injected onto an outer wall of the aperture with a directional component in a downstream direction.

5. The system of claim 1 further comprising:

means for sensing pressure of the plug flow of high viscosity material in the pipeline downstream from the lubrication spool; and means for controlling the amount of lubricant applied to the plug flow based on the sensed pressure.

6. The system of claim 1 wherein the lubrication spool further comprises:

a first spool section, the first spool section being located immediately adjacent the first pipe when the lubrication spool is in the first position;

a second spool section, the second spool section being located immediately adjacent the second pipe when the lubrication spool is in the first position; and a reservoir defined entirely by the first and second spool sections, the lubrication passage providing a fluid path between the reservoir and the aperture.

7. The system of claim 6 wherein the coupling for connecting the first pipe section to the second pipe section is a plurality of bolts.

8. The system of claim 7 wherein the lubrication spool is removable from the first position by removing at least one but not all of the plurality of bolts.

9. The system of claim 6 wherein each lubrication passage is formed at an angle relative to the aperture such that lubricant is injected onto an outer wall of the aperture with a directional component in a downstream direction.

10. In a pipeline for conveying high viscosity material, a system for lubricating a plug flow of high viscosity material in the pipeline, the system comprising:

a first pipe through which the plug flow of high viscosity material is pumped;

a second pipe through which the plug flow of high viscosity material is pumped, the second pipe being located downstream from the first pipe and at least partially separated from the first pipe;

a lubrication spool for lubricating the plug flow of high viscosity material with lubricant from a lubricant source, the lubrication spool located in a first position between the first pipe and the second pipe during lubrication, the lubrication spool comprising:

a first spool section, the first spool section being located immediately adjacent the first pipe when the lubrication spool is in the first position;

a second spool section, the second spool section being located immediately adjacent the second pipe when the lubrication spool is in the first position;

an aperture, in the first and second spool sections, providing a passage for the plug flow of high viscosity material being pumped between the first and second pipes; and a lubrication passage located between the first and second spool sections for applying lubricant to the plug flow of high viscosity material being pumped between the first and second pipes; and an adjusting means for adjusting the amount of lubricant applied to the plug flow of high viscosity material, the adjusting means comprising:

means for sensing pressure of the plug flow of high viscosity material in the pipeline downstream from the lubrication spool; and means for controlling the amount of lubricant applied based upon the sensed pressure.

11. The system of claim 10 wherein the lubrication passage is a circumferential lubrication passage.

12. The system of claim 10 wherein the lubrication passage is formed at an angle relative to the aperture such that lubricant flowing from the lubricant source to the aperture has a directional component which is in a same direction as the plug flow of high viscosity material.

13. The system of claim 10 wherein the means for controlling the amount of lubricant applied causes the lubricant source to start supplying lubricant to each lubrication passage when the sensed pressure of the plug flow of high viscosity material exceeds a predetermined value.

14. The system of claim 10 wherein the means for controlling the amount of lubricant applied causes the lubricant source to supply lubricant to each lubrication passage at a higher rate as the sensed pressure of the plug flow of high viscosity material increases.

15. A lubrication spool for lubricating a flow of high viscosity material in a pipeline, the lubrication spool comprising:

a first spool section, the first spool section comprising:

first and second sides; and an aperture extending from the first side to the second side;

a second spool section in contact with the first spool section, the second spool section comprising:

first and second sides; and an aperture extending from the first side of the second spool section to the second side of the second spool section, the aperture of the first spool section and the aperture of the second spool section being aligned to create an aperture through the first and second spool sections when the second side of the first spool section is positioned immediately adjacent the first side of the second spool section;

a lubrication passage formed between the first and second spool sections for applying lubricant to an outer wall of the aperture of the second spool section;

wherein the lubrication spool has a thickness measured from the first side of the first spool section to the second side of the second spool section when the second side of the first spool section is positioned immediately adjacent the first side of the second spool section; and wherein the lubrication spool has a diameter, perpendicular to the thickness, the diameter measured between the edges of the lubrication spool and passing through the center of the lubrication spool, the thickness being smaller than the diameter.

16. The lubrication spool of claim 15 wherein the lubrication passage is a circumferential passage for applying a uniform ring of lubricant to the outer wall of the aperture of the second spool section.

17. The lubrication spool of claim 15 wherein the lubrication passage is formed at an angle so that lubricant is injected onto the outer wall of the aperture of the second spool section with a component in a downstream direction.

18. The lubrication spool of claim 15 wherein part of the second side of the first spool section defines a first part of a reservoir and part of the first side of the second spool section defines a second part of a reservoir, the first part of the reservoir and the second part of the reservoir defining the entirety of the reservoir when the first spool section is positioned immediately adjacent the second spool section.

19. The lubrication spool of claim 18 further comprising:

an inlet in fluid connection with the reservoir, the inlet being connectable to a source of lubricant for supplying lubricant to the reservoir.

* * * * *